US005311198A

United States Patent [19]

Sutton

[11] Patent Number: 5,311,198

[45] Date of Patent: May 10, 1994

[54] ACTIVE ANTENNA

[75] Inventor: John F. Sutton, Dayton, Md.

[73] Assignee: The United States of America as represented by the Administrator of the National Aeronautics and Space Administration, Washington, D.C.

[21] Appl. No.: 571,060

[22] Filed: Aug. 23, 1990

[51] Int. Cl.[5] ..... H01Q 1/24

[52] U.S. Cl. ..... 343/701; 455/291

[58] Field of Search ..... 343/701, 850, 860; 455/291; H01Q 1/26, 1/22, 1/24

[56] References Cited

U.S. PATENT DOCUMENTS

| | | | |
|---|---|---|---|
| 3,716,867 | 2/1973 | Mayes et al. | 343/701 |
| 3,953,799 | 4/1976 | Albee | 343/701 |
| 4,383,260 | 5/1983 | Ryan | 343/701 |
| 4,442,434 | 4/1984 | Baekgaard | 343/701 |

FOREIGN PATENT DOCUMENTS

| | | | |
|---|---|---|---|
| 46-36380 | 10/1971 | Japan | 343/701 |

*Primary Examiner*—Michael C. Wimer

*Attorney, Agent, or Firm*—Ronald F. Sandler; Robert D. Marchant; Guy M. Miller

[57] ABSTRACT

An antenna, which may be a search coil, is connected to an operational amplifier circuit which provides negative impedances, each of which is in the order of magnitude of the positive impedances which characterize the antenna. The antenna is connected to the inverting input of the operational amplifier, a resistor is connected between the inverting input and the output of the operational amplifier, a capacitor-resistor network, in parallel, is connected between the output and the noninverting input of the operational amplifier, and a resistor is connected from the noninverting input and the circuit common. While this circuit provides a negative resistance and a negative inductance, in series, which appear, looking into the noninverting input of the operational amplifier, in parallel with the antenna, these negative impedances appear in a series loop with the antenna positive impedances, so as to algebraically add. This circuit is tuned by varying the various circuit components so that the negative impedances are very close, but somewhat less, in magnitude, to the antenna impedances. The result is to increase the sensitivity of the antenna by lowering its effective impedance. This, in turn, increases the effective area of the antenna, which may be broadband.

1 Claim, 1 Drawing Sheet

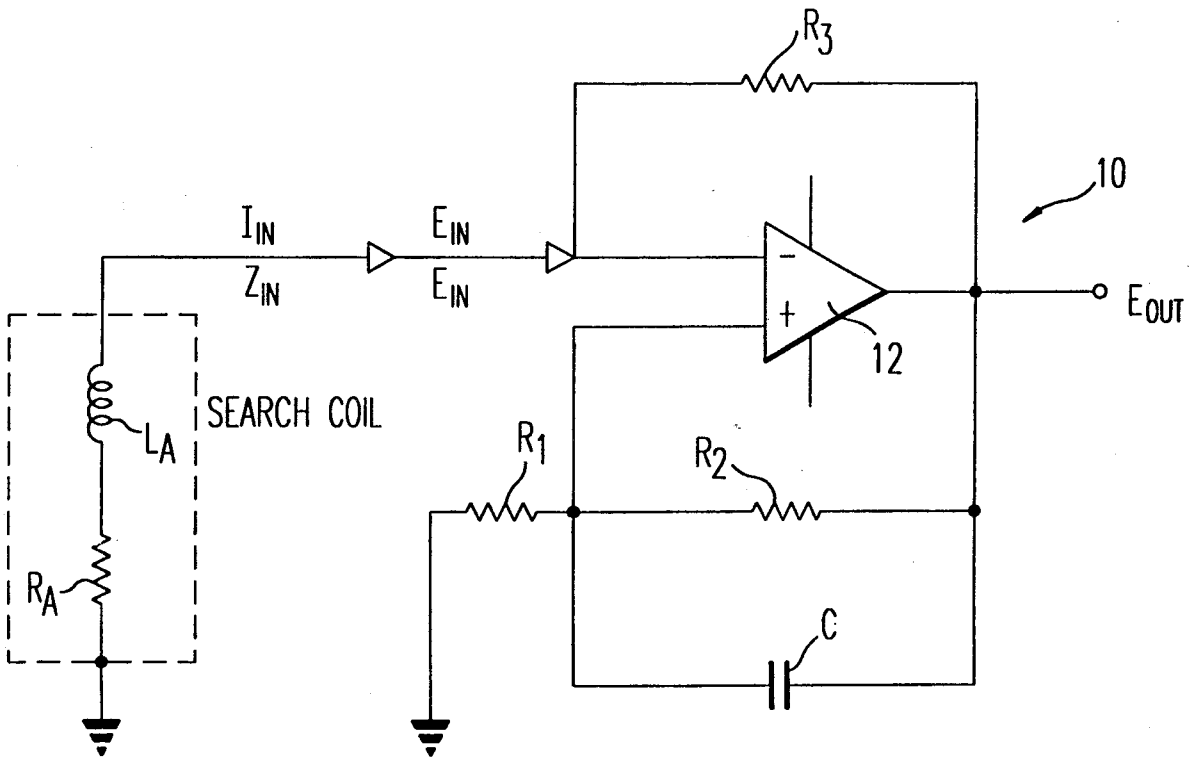
10
$E_{OUT}$
12
$R_3$
$R_2$
C
$R_1$
$E_{IN}$
$E_{IN}$
$I_{IN}$
$Z_{IN}$
SEARCH COIL
$L_A$
$R_A$

ACTIVE ANTENNA

ORIGIN OF THE INVENTION

The invention described herein was made by an employee of the United States Government, and may be manufactured and used by or for the Government for government purposes without the payment of any royalties thereon or therefor.

TECHNICAL FIELD

This invention pertains to antennas, and, more particularly, to active antennas.

PRIOR ART

Historically, in the 1920s, experimenters commonly employed regeneration in simple vacuum tube radio receivers. Typically these early receivers consisted of an inductor-capacitor (LC) tuned circuit coupled to a long wire antenna and to the grid circuit of a vacuum triode. Some of the energy from the anode circuit was link coupled via a "tickler coil" back to the grid-antenna circuit. Such feedback, which is equivalent to introduction of negative resistance into the antenna-grid circuit, required careful tuning to prevent unstable operation, e.g., oscillation. Because of the desire to obtain maximum sensitivity, and because of motion of the antenna wire due to wind or other disturbances, these regenerative detectors often went into oscillation. The broadcast bands became cluttered with spurious signals from many oscillating detectors, so the practice of applying regeneration to the antenna-grid circuits fell into disuse. The regeneration was subsequently applied to a second amplifier stage which was isolated from the antenna circuit by a buffer tube circuit. This practice resulted in the substantial reduction of the spurious signals on the broadcast band, but the removal of feedback from the antenna circuit also resulted in substantial reduction of sensitivity.

The reason why an antenna with regeneration has greater sensitivity than one without regeneration may be understood in terms of the concept of antenna "effective area." The first to explain why an antenna may have an effective area larger than the geometric area was Reinhold Rudenberg in 1908, in his article entitled, "Der Empfang Electrischer Wellen in der Drahtlosen Telegraphie", published in Annalen der Physik, Band, 25, P.446. Fundamentally, Rudenberg teaches that the antenna interacts with an incoming field, which may be approximately a plane wave, causing a current to flow in the antenna, by induction. The current, which may be enhanced by regeneration, in turn, produces a field in the vicinity of the antenna, which field, in turn, interacts with the incoming field in such a way that the incoming field lines are bent. The field lines are bent in such a way that energy is caused to flow from a relatively large portion of the incoming wave front, having the effect of absorbing energy from the wave front into the antenna from an area of the wave front which is much larger than the geometrical area of the antenna. Articles by Ambrose Fleming: "On Atoms of Action, Electricity, and Light", published in Philosophical Magazine 14, p.591, July-December., 1932, by Craig F. Bohren: "How Can a Particle Absorb More Than the Light Incident on It?", Am. J. Phys. 51, No. 4, P.323, April, 1983, and by H. Paul and R. Fischer: "Light Absorption by a Dipole", Sov. Phys. Usp.26, No.10, P.923, October, 1983, generally elaborate on the teaching of Rudenberg. It should be noted at this point that these teachings were directed at tuned antennas or mathematically analogous situations encountered in atomic physics.

Thus, from teachings such as Rudenberg, as well as Fleming, Bohren, and Paul and Fischer, antennas, at least tuned, or resonant, antennas may be said to have a much greater effective area than their geometric area. Regeneration reduces the resistance of the antenna circuit, resulting in increased antenna current and, therefore, increased antenna-field interaction, resulting in absorption of energy from an even larger effective area of the incoming field. In effect, these teachings explain an inherent physical phenomenon, rather than teaching how to achieve a particular effect. These teachings do not include how to maximize the effect or how to provide such an effect in the broad band case. With a tuned antenna there is always a tuned circuit including the antenna, where a capacitive reactance is effectively cancelled by an inductive reactance which leads, in turn, to a large circulating current in the resonant circuit, which results in the production of a field. This field, in turn, interacts with the incoming field.

STATEMENT OF THE INVENTION

Accordingly, it is an object of this invention to provide an improved antenna system.

It is another object of this invention to provide an improved active antenna system.

It is yet another object of this invention to provide an improved broadband active antenna system.

It is yet another object of this invention to provide an improved active antenna system having an extremely low, predetermined antenna circuit impedance.

It is a further object of this invention to provide an improved active antenna system by incorporating a negative impedance in the antenna system.

Briefly, the foregoing and other objects may be obtained by providing an antenna with positive inductance and positive resistance, a circuit with negative inductance and negative resistance, each of which having magnitudes that are in the order of the positive inductance and positive resistance of the antenna, but somewhat less, the antenna and the circuit being connected in a fashion whereby the positive and negative impedances add algebraically and the total antenna-plus-circuit impedance appears as a slightly positive resistance and inductance.

BRIEF DESCRIPTION OF THE DRAWINGS

FIG. 1 is a schematic diagram of one embodiment of a low impedance, active antenna system according to the invention.

DETAILED DESCRIPTION OF THE INVENTION

It is desirable to have a very sensitive antenna for the purpose of detecting low level fields, e.g., low level magnetic fields. It is also desirable to have this sensitive antenna exhibit a broadband frequency characteristic for, among other reasons, to satisfy the requirements of modern, fast-Fourier transform data analysis instruments, where it is often desirable to analyze broadband signals rather than single frequency or narrow band signals. For example, the antennas commonly employed for sensing ELF magnetic fields consist of search coils comprised of several thousand turns of copper wire wound around high permeability, low loss cores, such as ferrite rods. To enhance the performance of such a search coil antenna, it is desirable to reduce the wire resistance and the inductive reactance of the coil, both of which impede the signal-generated current flow in the coil. A low coil impedance implies a large coil current, which, in turn, implies a large effective area and hence, a high sensitivity. By careful design, the coil resistance and inductance can be somewhat reduced. It is a purpose of this invention to further reduce the coil impedance to arbitrarily small values by electronic means.

In most circumstances, a search coil impedance may be shown to be, to a good approximation, a resistance $R_A$ in series with an inductance $L_A$. As discussed above, a search coil with only inductance and resistance and no capacitance, and no impedances coupled in from the environment, is defined as an ideal search coil. If such a coil were connected in series with a negative impedance circuit, i.e., an appropriate negative resistance in series with an appropriate negative inductive reactance, the total combined impedance of the coil and the negative impedance circuit could be made as small as desired. If the total combined impedance is made positive, but very small, a very sensitive search coil system may result.

If the search coil is connected to the inverting input terminal of an operational amplifier, and the operational amplifier and its associated circuitry are employed to develop a negative resistance and negative inductance which is, in magnitude, essentially equivalent to the positive resistance and inductance of the search coil, then the input impedance looking into the inverting input terminal of the operational amplifier is:

$$Z_{IN} = \frac{E_{IN}}{I_{IN}} \tag{1}$$

The input current, accordingly, is:

$$I_{IN} = \frac{E_{IN} - E_{OUT}}{R_3} \tag{2}$$

Now, the output voltage is:

$$E_O = E_{IN}x\left(1 + \frac{Z_2}{R_1}\right) \tag{3}$$

where $Z_2$ is the impedance formed by the parallel combination of $R_2$ and C. Substituting (2) and (3) into (1) yields:

$$Z_{IN} = \frac{-R_1R_3}{R_2} - jwCR_1R_3 \tag{4}$$

Thus, the input impedance is a negative resistance having a value:

$$R_{EFF} = \frac{-R_1R_3}{R_2} \tag{5}$$

and a negative inductance having a value:

$$L_{EFF} = -CR_1R_3 \tag{6}$$

One circuit employing an operational amplifier to furnish the required negative resistance and negative inductance is shown as circuit 10 of FIG. 1. As shown, the antenna, in the form of a search coil, broken up into its components, $R_A$ and $L_A$, is connected between the signal common and the inverting input of operational amplifier 12, which may be a Precision Monolithics OP-77. $R_{EFF}$ and $L_{EFF}$ appear in series as the input impedance to operational amplifier 12 at its inverting input. In other words, the impedance looking into the inverting input of operational amplifier 12 appears as $R_{EFF}$ and $L_{EFF}$ in series with each other, but are, in turn, in parallel with the search coil. The equivalent circuit of FIG. 1 is therefore a series combination of the search coil in series with $R_{EFF}$ and $L_{EFF}$. Thus, by carefully selecting component values, the values of $R_{EFF}$ and $L_{EFF}$ are adjusted so that the total circuit impedance consists of a very small but positive resistance in series with a very small but positive inductive reactance. The smaller the positive circuit impedance, the larger the effective area, and the more sensitive the antenna. If the effective circuit impedance components are negative, circuit instability may result. As a practical matter, because of unavoidable circuit instability and noise, attempting to make the circuit impedance too small may result in oscillation.

Up to this point we have considered, for the purpose of simplicity of analysis, the case of an idealized search coil having only a positive resistance and a positive inductance. In reality, impedances will couple into the antenna circuit from the environment. In some cases, this coupling may be significant. In any event, as a practical matter, the active antenna is tuned so that the total antenna circuit resistance, including environmentally-coupled resistance, is small, but positive, and the total antenna circuit inductance, including environmentally-coupled inductance, is also small but positive. In some cases, environment-coupled capacitive effects must also be considered. The antenna impedances and the corresponding negative circuit impedances could be more complex than discussed here. Under most circumstances our simplified model is effective.

A search coil may typically have an inductance of 2 henrys and a wire resistance of 50 Ohms. For use with such a search coil, operational amplifier 12, as shown in FIG. 1, has a resistor $R_3$, which may be on the order of 1 MegOhm, connected between its inverting input terminal and its output terminal. A capacitor, C, which may be on the order of 0.02 uF, and a resistor, $R_2$, which may be on the order of 2 MegOhms, are connected in parallel between the operational amplifier output terminal and its noninverting input terminal. A third resistor, $R_1$, which may be on the order of 100 Ohms, is connected from the operational amplifier noninverting amplifier input and signal common. For the purpose of maintaining dc circuit stability, it may be desirable to place a dc blocking capacitor of, for instance, 100 uF in series between the operational amplifier output and the resistor, $R_2$. For the purpose of maintaining high frequency circuit stability, a small capacitor, in the order of about 30 pF, may be placed across resistor $R_3$.

Operation of the FIG. 1 circuit as a negative impedance (pre)amplifier can be readily understood by first assuming that the feedback network consisting of $R_1$, $R_2$, and C are removed from the circuit and that the noninverting terminal of the operational amplifier, 12, is connected to the circuit common. Then the inverting input terminal is also at the circuit common potential and is, therefore, a virtual ground. When the search coil, which is connected to the operational amplifier inverting input, produces a current due to excitation by an external magnetic field, the current travels through $R_3$ to the amplifier output terminal, developing a voltage proportional to this current at the output terminal in the process. Thus, the operational amplifier in this configuration functions as a current-to-voltage converter. With the ground removed from the noninverting input terminal and feedback resistors $R_1$ and $R_2$ connected in the voltage divider configuration as shown in FIG. 1, a portion of the output voltage is applied to the noninverting input. This positive feedback introduces negative resistance into the search coil circuit with the result that some of the coil resistance, $R_A$, is effectively removed. If the capacitor, C, is added to the voltage divider circuit between the operational amplifier output terminal and its noninverting input terminal, the voltage divider provides more positive feedback at the higher frequencies. This increasing positive feedback largely overcomes the search coil inductive reactance which also increases with frequency. Thus, the complete positive feedback divider circuit, consisting of $R_1$, $R_2$, and C, is responsible for introducing negative resistance and negative inductance into the amplifier circuit.

The description above presumes an antenna connection to the inverting input of an operational amplifier. It has been found than an operational amplifier circuit can be employed to develop the desired negative impedances by connecting the antenna to the noninverting input of an operational amplifier. In such a configuration, a resistor would be connected from the operational amplifier output to the noninverting input, a parallel combination of a resistor and a capacitor would be connected from the operational amplifier output to the inverting input, and a resistor would be connected from the inverting input to circuit common. This circuit, for stability, must be adjusted to produce a total antenna-preamplifier circuit impedance which consists of a small positive resistance and a small negative inductive reactance. The result is that this configuration has the opposite effect of the circuit of FIG. 1, i.e., instead of attracting field lines to increase the effective area, it repels field lines. Such operation may be useful, for example, in antenna arrays, where it may be desirable to have one or more antenna elements that repel field lines while one or more other antenna elements attract field lines.

Prior to establishing the approximate parameters for circuit 10, the inductance and resistance of the particular antenna must be ascertained. To tune this active antenna circuit for optimum signal reception, the capacitor C would be made variable. By leaving $R_1$ and $R_3$ fixed, according to equation (6), one could vary $L_{EFF}$ by varying C. A larger value of C results in a larger value of synthesized negative inductance, and a smaller value of C results in a smaller value of synthesized negative inductance. If $R_1$ and $R_3$ are left fixed, then the synthesized negative resistance will be inversely proportional to $R_2$. Increasing $R_2$ will result in a smaller value of synthesized negative resistance. Thus, tuning the active antenna of this invention would consist of several steps. First, C would be adjusted until the negative inductance is close to, in magnitude, but not greater than, the magnitude of the positive inductance. Then, $R_2$ would be adjusted so that the magnitude of the synthesized negative resistance is close to, but not greater than, the magnitude of the positive search coil resistance, $R_A$. If the circuit goes into oscillation, the magnitude of the synthesized negative resistance should be reduced by slightly increasing the magnitude of $R_2$.

It should be noted at this point that the particular circuit or embodiment employed with the search coil used to form an active antenna is not particularly critical. What is critical is that the search coil, or other antenna, be connected to an active circuit which introduces negative resistance and negative inductance in series with the antenna so that the total search coil-amplifier input circuit impedance is low over a large range of frequencies. In the particular embodiment disclosed herein, the negative resistance and the negative inductance magnitudes remain essentially constant over the entire ELF band, which extends from about 3 Hz to 3 kHz. In this embodiment, the negative resistance and inductance appear in parallel with the antenna positive resistance and inductance with respect to the inverting input of operational amplifier 12 but the negative resistance and inductance appear in series with the positive antenna impedances around the loop from the circuit common back to the circuit common. Thus, the values of these circuit components add or subtract algebraically.

Achieving a low, but positive, net impedance is desirable so that a large current will flow in the search coil when it is excited by an external magnetic field. This large current will, in turn, cause the antenna to have a large effective area, and hence, a high sensitivity.

In some circumstances, where the real positive capacitance associated with a particular antenna is large, it may be important to add a negative capacitance to the active antenna circuit in order to remove the effect of the capacitance. With most antennas, however, it appears that the capacitance is small enough to be ignored. In principle, a negative capacitance can be added with active circuitry which is analogous to that disclosed herein to provide the negative resistance and negative inductance.

I claim:

1. An active antenna including an antenna and circuit means:

said antenna having positive inductance and positive resistance, including any impedances coupled into said antenna from its environment;

said circuit means, including a signal common and an operational amplifier, coupled to, and driven by, said antenna, for providing a negative inductance and a negative resistance, the magnitude of said negative inductance being approximately equal to the magnitude of said antenna positive inductance but somewhat less, and the magnitude of said negative resistance being approximately equal to the magnitude of said antenna positive resistance but somewhat less;

said antenna being connected to the inverting input of said operational amplifier, a resistor being connected from said inverting input to the output of said operational amplifier, a resistor-capacitor parallel network being connected from said output to the noninverting input of said operational amplifier, and a resistor being connected from said noninverting input to the signal common; and said antenna and said circuit means being connected in a configuration which provides an algebraic addition of said positive and negative inductances and resistances, with the total active antenna impedance being a very small, but positive, series inductance and resistance, sufficient in magnitude to maintain the stability of said active antenna in its operation environment.

* * * * *